US008860389B2

(12) United States Patent
Gakhar et al.

(10) Patent No.: US 8,860,389 B2
(45) Date of Patent: Oct. 14, 2014

(54) FAST LOAD TRANSIENT RESPONSE CIRCUIT FOR AN LDO REGULATOR

(75) Inventors: Vikram Gakhar, Bangalore (IN); Preetam Charan Anand Tadeparthy, Bangalore (IN)

(73) Assignee: Texas Instruments Incorporated, Dallas, TX (US)

( * ) Notice: Subject to any disclaimer, the term of this patent is extended or adjusted under 35 U.S.C. 154(b) by 608 days.

(21) Appl. No.: 12/649,015

(22) Filed: Dec. 29, 2009

(65) Prior Publication Data

US 2011/0156671 A1 Jun. 30, 2011

(51) Int. Cl.
*G05F 1/575* (2006.01)
*G05F 1/563* (2006.01)

(52) U.S. Cl.
CPC ..... *G05F 1/563* (2013.01)
USPC ..... 323/280; 323/271; 323/273

(58) Field of Classification Search
USPC ..... 323/223–226, 271–274, 280
See application file for complete search history.

(56) References Cited

U.S. PATENT DOCUMENTS

| | | | | |
|---|---|---|---|---|
| 4,855,623 | A * | 8/1989 | Flaherty | 326/87 |
| 5,811,997 | A * | 9/1998 | Chengson et al. | 327/112 |
| 6,333,623 | B1 * | 12/2001 | Heisley et al. | 323/280 |
| 6,806,690 | B2 * | 10/2004 | Xi | 323/273 |
| 7,132,880 | B2 * | 11/2006 | Ingino, Jr. | 327/541 |
| 7,589,507 | B2 * | 9/2009 | Mandal | 323/273 |
| 2002/0171479 | A1 * | 11/2002 | Wouters | 330/69 |
| 2004/0000896 | A1 * | 1/2004 | Barber et al. | 323/280 |
| 2005/0237094 | A1 * | 10/2005 | Stark et al. | 327/170 |
| 2007/0108950 | A1 * | 5/2007 | Kakinuma | 323/280 |
| 2011/0068849 | A1 * | 3/2011 | Grover | 327/381 |

* cited by examiner

*Primary Examiner* — Adolf Berhane
*Assistant Examiner* — Gustavo Rosario Benitez
(74) *Attorney, Agent, or Firm* — William B. Kempler; Frederick J. Telecky, Jr.

(57) ABSTRACT

A fast load transient response circuit includes a feedback loop that senses a load transient; a first driver and a second driver responsive to a feedback signal from the feedback loop; and a first pass transistor and a second pass transistor with sources and drains being coupled to each other, and a gate of the first pass transistor being driven by the first driver and a gate of the second pass transistor being driven by the second driver. A width of the channel to length of the channel (W/L) ratio of the first pass transistor is different than that of the second pass transistor such that second pass transistor reacts faster than the first pass transistors to a load transient.

6 Claims, 3 Drawing Sheets

FAST LOAD TRANSIENT RESPONSE CIRCUIT FOR AN LDO REGULATOR

TECHNICAL FIELD

Embodiments of the disclosure relate to fast load transient response circuit in a low dropout (LDO) regulator.

BACKGROUND

An LDO regulator is a type of linear regulator. A linear regulator uses a transistor, to subtract excess voltage from the applied input voltage and produces a regulated output voltage. Dropout voltage is the minimum input to output voltage differential required for the regulator to sustain an output voltage at its nominal value. LDO regulators use a pass transistor for controlling output voltages. The LDO is sometimes operated with very low voltage across the pass transistor, i.e. very close to dropout. The size of the pass transistor of an LDO regulator is determined by its dropout specification. Typically, the size of the pass transistor is much larger than what is required to meet the load transient specification. In case of a load transient, driving the gate of a pass transistor that is larger than what is necessary delays and degrades the response to a load transient. What is needed is a circuit that can respond fast to load transient in LDO regulators.

SUMMARY

An example embodiment provides a fast load transient response circuit in a low dropout (LDO) regulator. The fast load transient response circuit includes a feedback loop that senses a load transient; a first driver and a second driver responsive to a feedback signal from the feedback loop; and a first pass transistor and a second pass transistor with sources and drains being coupled to each other, and a gate of the first pass transistor being driven by the first driver and a gate of the second pass transistor being driven by the second driver. A width of the channel to length of the channel (W/L) ratio of the first pass transistor is different than that of the second pass transistor such that second pass transistor reacts faster than the first pass transistors to a load transient.

An example embodiment provides a fast load transient response circuit. The fast load transient response circuit includes a feedback loop that senses a load transient; a set of drivers responsive to a feedback signal from the feedback loop; and a set of transistors with sources and drains being coupled to each other. Gates of each of the set of pass transistors being individually driven by corresponding each of the set of drivers. The W/L ratio of each pass transistor of the set of pass transistors are in such a way that gain of each pass transistor and an input capacitance offered by each pass transistor to the corresponding driver are optimized to provide a fast load transient response.

An example embodiment provides a method for achieving fast transient response in a circuit. A load transient is sensed. In response to the load transient, a set of drivers that drives a set of pass transistors are activated. W/L ratio of each of the set of pass transistors are in such a way that gains of each of the set of pass transistors and an input capacitance offered by each of the set of pass transistors to the corresponding driver are optimized to provide a fast load transient response. Then, gates of each of the set of pass transistors are driven individually using the set of drivers.

Other aspects and example embodiments are provided in the Drawings and the Detailed Description that follows.

BRIEF DESCRIPTION OF THE VIEWS OF DRAWINGS

DETAILED DESCRIPTION OF THE EMBODIMENTS

Figure 1:
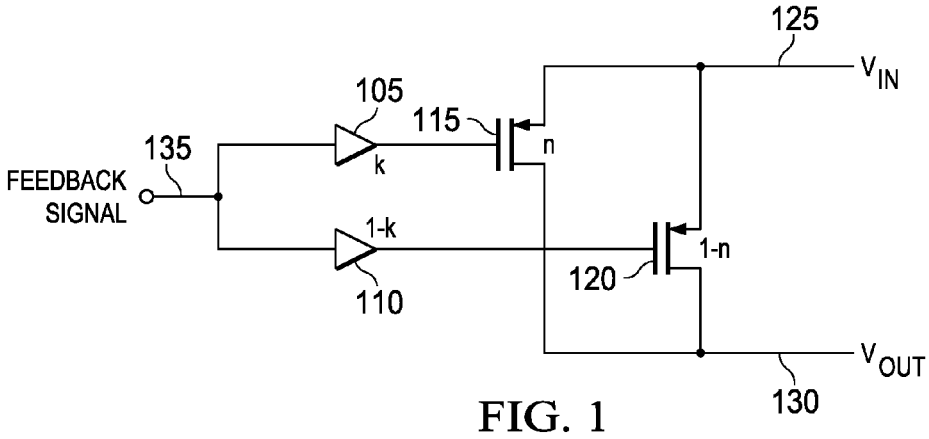
FIG. 1 illustrates a fast load transient response circuit according to an embodiment.

Embodiments of the disclosure provide a fast load transient response circuit. One embodiment provides a fast load transient response circuit for a low dropout (LDO) regulator. Various embodiments are explained using an LDO regulator as an example. However, it will be appreciated that various embodiments can be used in other voltage regulators and amplifiers. In one embodiment the fast load transient response circuit includes a pass transistor of the LDO regulator that is split with disproportionately sized drivers.

Various embodiments minimize the quiescent current and size of the LDO regulator by driving a part of the pass transistor that is just enough to respond to a load transient. For the same quiescent current and silicon area, better load transient can be achieved, or the same load transient performance can be achieved with less quiescent current and silicon area.

It is noted that LDO regulator needs a smaller pass transistor than the dropout specification, which is discussed below. It is also noted that a smaller pass transistor has faster response than a larger pass transistor, which is discussed thereafter.

Using an example, it is explained why an LDO regulator requires a smaller pass transistor than the dropout specification. Consider an LDO with the following specification:

Output voltage=2V

Nominal input voltage=output voltage+0.5V=2.5V

Maximum load current, $I_D$=200 mA

Dropout voltage=100 mV

Threshold voltage, $V_T$ of the pass transistor=0.6V

In dropout, the pass transistor is in linear mode of operation, the input voltage of the LDO regulator is close to the rated output voltage and the gate is at ground potential. Then the expression for the drain current of the pass transistor can be expressed as:

$$I_D=K*(W_1/L)*[(V_{GS}-V_T)*V_{DS}-V_{DS2}/2]$$

$$200\text{ mA}=K*(W_1/L)*[(2-0.6)*0.1-0.1^2/2]$$

$$200\text{ mA}=K*(W_1/L)*0.135 \qquad \text{(Equation 1)}$$

Where $I_D$ is the drain current of the pass transistor, $V_{GS}$ is the gate source voltage of the pass transistor, $V_{DS}$ is the drain source voltage of the pass transistor, $W_1/L$ is the width to length of the channel (W/L) ratio of the pass transistor and K is the process transconductance parameter.

It is noted that the pass transistor is in linear mode of operation when responding to a load transient. The gate is close to ground, but the input is at the nominal voltage. If the amplifier provides just enough current to supply to the load, the expression would be:

$$I_D=K*(W_2/L)*[(V_{GS}-V_T)*V_{DS}-V_{DS2}/2]$$

$$200\text{ mA}=K*(W_2/L)*[(2.5-0.6)*0.5-0.5^2/2]$$

$$200\text{ mA}=K*(W_2/L)*0.825 \quad \text{(Equation 2)}$$

where $W_2/L$ is the width to length of the channel ratio of the pass transistor.

Comparing equation (1) and equation (2), the ratio of sizes of the pass transistor required to meet the dropout and load transient specifications can be expressed as:

$$W_1/W_2=0.825/0.135=6.1 \quad \text{(Equation 3)}$$

In practice, during load transient, extra current would be needed in addition to the current drawn by the load to recharge the output capacitor of the LDO regulator and restore the output voltage to a nominal value. If the extra current is equal to the load current, then the ratio (as in equation 3) becomes 3. In other words, to meet the load transient specification, the pass transistor can be 3 times smaller than what it needs to be for the dropout specification.

Depending on particular circuit parameters and operating conditions, the pass transistor may even remain in saturation mode during the transient because of the large $V_{DS}$. In such a case the size of the pass transistor needed to provide transient current would be even smaller than what is calculated above assuming linear mode of operation. However, we proceed with the assumption and show that a smaller pass transistor can deliver load transient current faster as follows.

Calculation showing that a smaller pass transistor has faster response than a larger pass transistor is discussed now. Compare two pass transistors of relative sizes 1:p that provide transient current from no load to full load. Even though the pass transistor may enter into a linear mode of operation during the transient, before the transient as well as after the transient is over and the LDO regulator is regulating in steady state, the pass transistor would be operating in the saturation mode. Then, current (I) in the pass transistor can be expressed as:

$$I \propto W*(V_{GS}-V_T)^2 \quad \text{(Equation 4)}$$

Wherein 'W' is the width of the channel of the pass transistor.

Table 1 shows the ratio of various parameters of the second pass transistor in relation to the first pass transistor:

TABLE 1

| | Parameter compared | Relative values of the parameter for the two sizes | |
|---|---|---|---|
| Initial assumption about sizes | W | 1 | p |
| Load current step (ΔI), no load to full load | $\Delta I = I_{LOAD} - 0 = I_{LOAD}$ | 1 | 1 |
| Gate capacitance ($C_{GS}$) | $C_{GS} \propto W$ | 1 | p |
| Change in gate voltage ($\Delta V_{GS}$) between no load and full load | $\Delta V_{GS} \propto [\Delta I/W]^{1/2}$ | 1 | $p^{-1/2}$ |
| Charge to be moved out of the gate (ΔQ) | $\Delta Q \propto \Delta V_{GS} * C_{GS}$ | 1 | $p^{1/2}$ |

From table 1 it can be noted that for the same change in load current, the gate voltage of the smaller pass transistor has to swing more compared to the bigger pass transistor (note $p^{-1/2}$ in the table). However, the swing is compensated by the gate capacitance of the smaller pass transistor in a way that the charge to be moved out of the gate is smaller. With p=3, ΔQ is smaller by a ratio of $1/\sqrt{3}=0.58$. With the smaller pass transistor, the amplifier needs to drive 0.58 times smaller current, and therefore can provide load current faster to recover from the load transient.

Having proved that LDO regulator needs a smaller pass transistor than the dropout specification, and that a smaller pass transistor has faster response than a larger pass transistor, the fast load transient response circuit according to an embodiment is now discussed.

Figure 2:
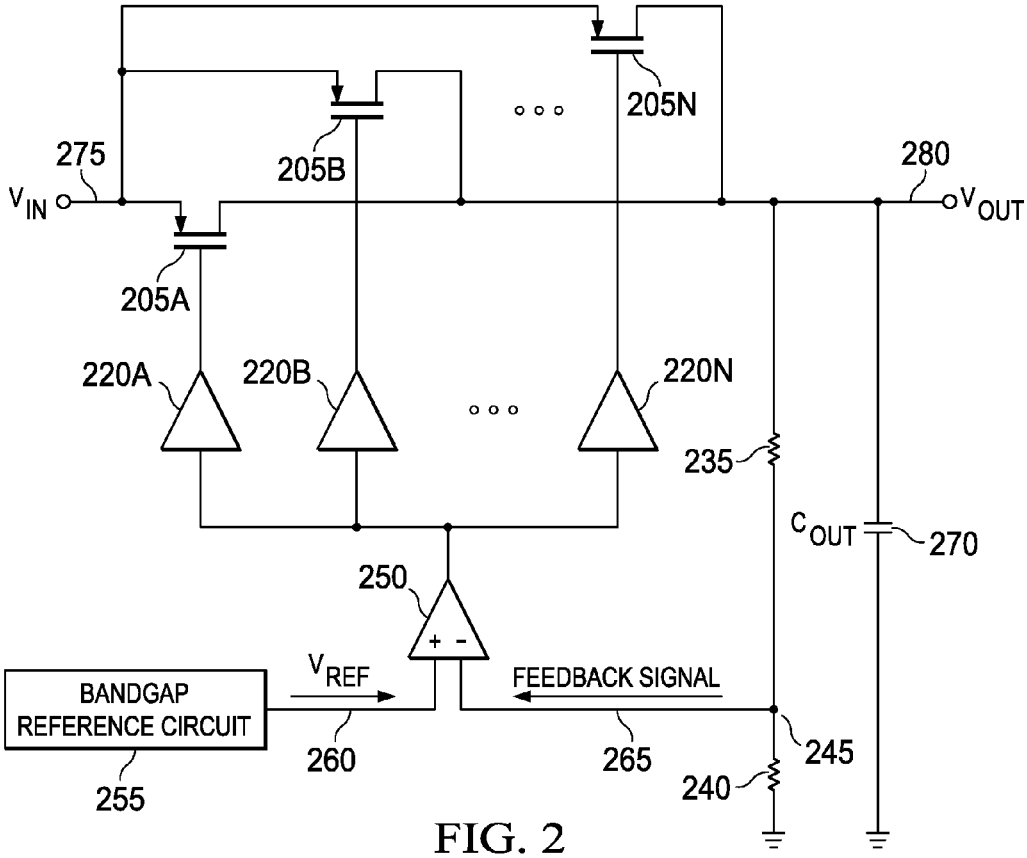
FIG. 2 illustrates a low dropout (LDO) regulator with a the fast load transient response circuit according to another embodiment.

Referring to FIG. 1, the fast load transient response circuit includes driver 105 (first driver) and driver 110 (second driver) that receives a feedback signal on a line 135. The feedback signal may be a feedback signal (265) from an output stage of an LDO regulator as illustrated in FIG. 2 (from a resistance divider at an output of a LDO regulator in FIG. 2). An output of the driver 105 is connected to a gate of a pass transistor 115 (first pass transistor). An output of the driver 110 is connected to a gate of a pass transistor 120 (first pass transistor). Transistors 115 and 120 are PMOS transistors in this embodiment. Sources and drains of the transistors 115 and 120 are shorted. Sources of transistor 115 and transistor 120 receive an input 'Vin' on a line 125. Drains of the transistors 115 and 120 generate an output on a line 130.

According to one embodiment the pass transistor is split into two sections, namely pass transistor 115 and pass transistor 120 with sources as well as drains of the two sections shorted together and the gates driven by separate drivers (105 and 110). The transistor 115 is sized for load transient. Pass transistor 115 and driver 105 together is referred to as a fast section. The transistor 120 and the driver 110 together is referred to as a slow section. The overall pass transistor (consisting of the fast section and the 'slow section') is sized to meet the dropout specification of the LDO regulator. It is noted that the sizes of the drivers 105 and 110 are not proportional to the sizes of the sections they drive. Instead, the driver 105 for the fast section is larger in relation to the fraction of the transistor (115) it drives. The drivers are sized according to the output driving capability and an output impedance of each driver. The output impedance of each driver is set in such a way to obtain a maximum bandwidth. The output driving capability is set in such a way to obtain fastest load transient response. If the ratio of the sizes of the fast section and the slow section is n:1−n and the ratio of the strengths of their drivers is k:1−k, then the drivers 105 and 110 are designed such that k/n is greater than 1.

In an event of a load transient at the output, a feedback loop (for example, the feedback loop illustrated in FIG. 2) senses the load transient and activates the drivers 105 and 110. Since the pass transistor is split according to the embodiment, the fast section (115), driven by the larger driver (105) is able to react faster than the way the overall pass transistor (transistor 115 and transistor 120 in combination) would have reacted if it were driven by a combined driver. The faster response from the fast section makes the load transient glitch smaller than if the pass transistor had not been split. In other words, a width of the channel to length of the channel (W/L) ratio of the pass transistor 110 is higher than that of the pass transistor 115 such that second pass transistor 115 reacts faster than the transistor 120 to a load transient and provides an output current.

FIG. 2 illustrates the implementation of the fast load transient response circuit in the LDO regulator. The LDO regulator receives an input ($V_{IN}$) on a line 275. A plurality of pass transistors (205A, 205B and 205N) is connected to the line 275. Source and drain terminals of the pass transistors are shorted. Source terminals of the pass transistors are connected to the line 275 that receives the input. Drain terminals of the pass transistors are connected to the line 280 where an output VOUT is defined. The plurality of pass transistors (205A, 205B and 205N) is implemented using PMOS transistors in this embodiment. The pass transistors can be implemented as NMOS transistors in other embodiments.

The LDO regulator includes a bandgap reference circuit 255 supplying a reference voltage ($V_{REF}$) to an inverting terminal of an operational amplifier 250 on the line 260. A non-inverting terminal of the operational amplifier 250 receives a feedback signal that is generated from a feedback node 245, on a line 265. The feedback node 245 is defined on a resistor divider (with resistors 235 and 240). The resistor divider is connected between the output 280 ($V_{OUT}$) and the ground. A feedback loop, that sense a load transient, consists of the resistor divider, the line 265 that provides the feedback signal and the operational amplifier 250. An output of the operational amplifier 250 is connected to a plurality of drivers (220A, 220B and 220N). Outputs of the plurality of the drivers (220A, 220B and 220N) are connected to corresponding pass transistors (205A, 205B and 205N) through the gates of those pass transistors. In other words, gates of each of the set of pass transistors are individually driven by corresponding each of the set of drivers. An output capacitor ($C_{OUT}$) 270 is connected between the output node 118 and ground.

The set of drivers (220A, 220B and 220N) is sized according to the output driving capability of each of the set of drivers and an output impedance of each of the set of drivers. The output impedance is set to obtain a maximum bandwidth and the output driving capability is set to obtain fastest load transient response. The set of drivers (220A, 220B and 220N) and the pass transistors (205A, 205B and 205N) are not sized proportionately. Instead, small pass transistors are connected to drivers that are larger than the fraction of the pass transistors they are driving. The smaller pass transistors are capable of providing the load transient current, and the drivers connected to them are larger so that they can react fast and provide load transient current sooner. It is noted that the pass transistor can be split into any number wherein a width of the channel to length of the channel (W/L) ratio of each pass transistor of the set of pass transistors (205A, 205B and 205N) are in such a way that gain of each pass transistor and an input capacitance offered by each pass transistor to the corresponding driver are optimized to provide a fast load transient response.

In an event of a load transient at the output of the LDO regulator, the feedback loop senses the load transient and activates the plurality of drivers (220A, 220B and 220N). Since the pass transistor is split in to the aforementioned condition, the set of pass transistors (205A, 205B and 205N) separate or in combination reacts fast to the load transient. The set of pass transistors then provides a required transient output current to a load at the output of the LDO regulator.

Figure 3:
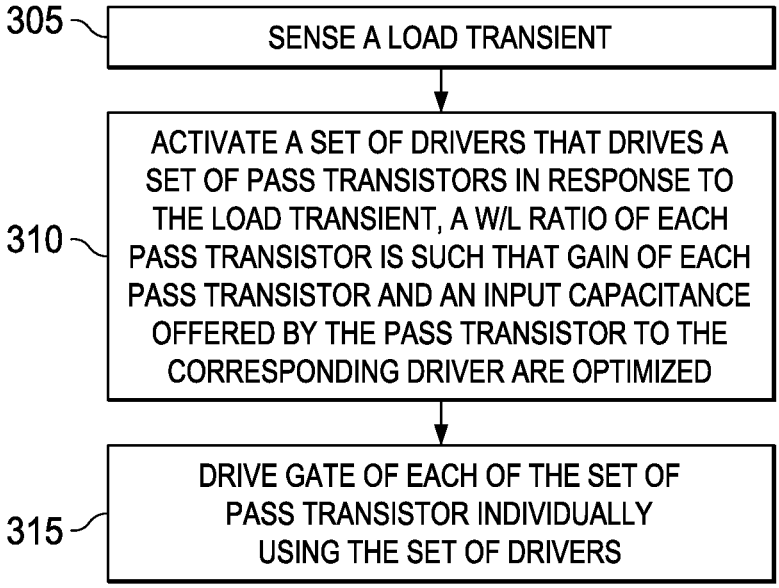
FIG. 3 illustrates a flow diagram according to an embodiment.

FIG. 3 is a flow diagram illustrating an embodiment. At step 305, a load transient is sensed using a feedback loop, for example the feedback loop as illustrated in FIG. 2. In response to the load transient, at step 310, a set of drivers are activated that in turn drives a set of pass transistors, for example the pass transistors 205A, 205B and 205N. A W/L ratio of the set of pass transistors is provided such that gains of each of the pass transistor and an input capacitance offered by each of the pass transistor are optimized. In other words, the pass transistor is split according to the aforementioned criterion. At step 315, the gates of each of the pass transistor that are split are individually driven using the set of drivers. In this embodiment, the set of drivers are sized according to the output driving capability of each of the set of drivers and an output impedance of each of the set of drivers. Further, the output impedance of each driver is to obtain a maximum bandwidth, and output driving capability of each driver is set to obtain fastest load transient response.

Figure 4A:
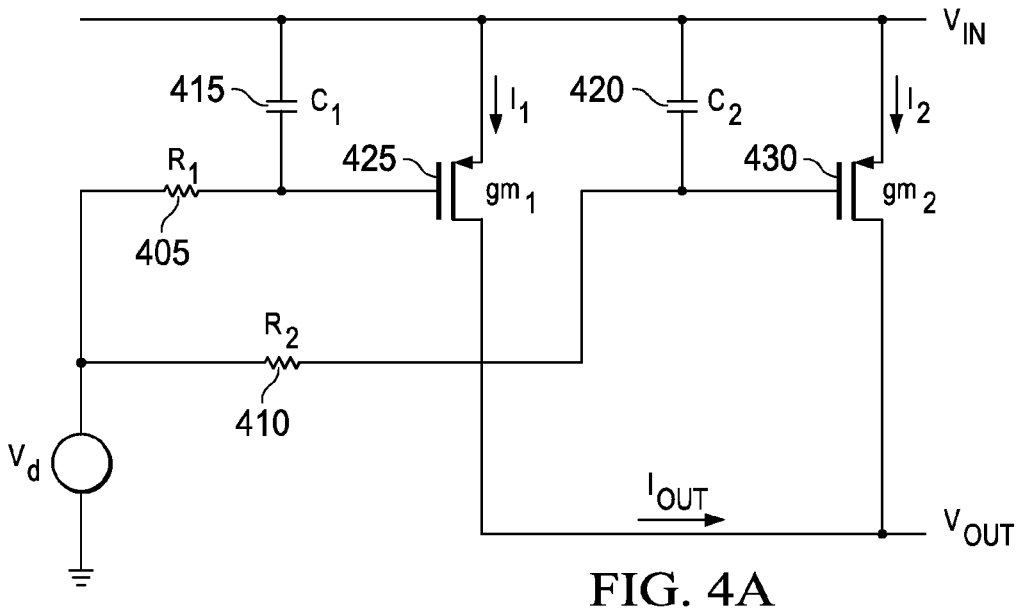
FIGS. 4A and 4B illustrate frequency domain analysis of an embodiment.
Figure 4B:
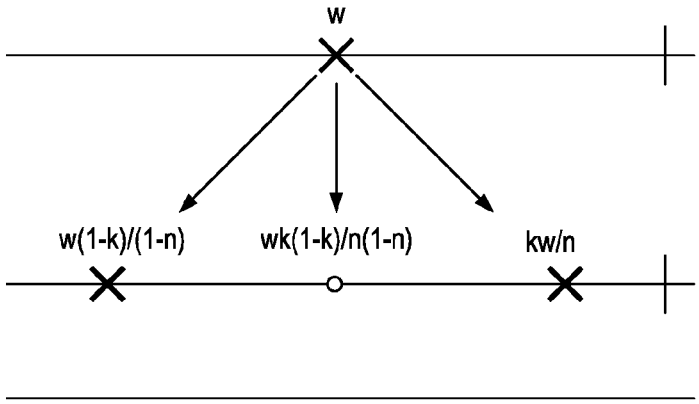

FIGS. 4A and 4B illustrate frequency domain analysis of an embodiment. Referring to FIG. 4A, consider a pass transistor that is split into two sections of relative sizes in the ratio 1:n driven by drivers of relative drive strengths in the ratio 1:k. Thevenin equivalents of the drivers are represented by the parallel connected resistors R1 (405) and R2 (410) and the voltage source Vd. Gain of the transistors 425 and 430 are represented as gm1 and gm2 respectively. Parasitic capacitance of the transistors 425 and 430 are represented are illustrated using capacitors C1 (415) and C2 (420). I1 is the current flowing through transistor 425 and I2 is the current flowing through the transistor 430.

Ratios of the pass transistor and the drivers are given by the following equations $$gm1/gm2=n/(1-n) \quad \text{(Equation 5)}$$

$$C_1/C_2=n/(1-n) \quad \text{(Equation 6)}$$

$$R_1/R_2=(1-k)/k \quad \text{(Equation 7)}$$

The two sections of the pass transistor and the driver together make up the whole transistor and the driver:

$$gm1+gm2=gm \quad \text{(Equation 8)}$$

$$C_1+C_2=C \quad \text{(Equation 9)}$$

$$1/R_1+1/R_2=1/R \quad \text{(Equation 10)}$$

$$gm1=n*gm, \quad \text{(Equation 11)}$$

$$gm2=(1-n)*gm \quad \text{(Equation 12)}$$

$$C_1=n*C, \quad \text{(Equation 13)}$$

$$C_2=(1-n)*C \quad \text{(Equation 14)}$$

$$R_1=R/k, \quad \text{(Equation 15)}$$

$$R_2=R/(1-k) \quad \text{(Equation 16)}$$

Total small signal current, $$\begin{aligned} I_{OUT} = I1 + I2 = & \quad \text{(Equation 17)} \\ gm1*V_{GS1} + gm2*V_{GS2} = gm1*Vd*(1/(1+sC_1R_1)) + & \\ gm2*Vd*(1/(1+sC_2R_2)) = & \\ n*gm*V_d*(1/(1+sC1R1)) + & \\ (1-n)*gm*V_d*(1/(1+sC_2R_2)) = & \\ gm*V_d*[\{n/(1+sCRn/k)\} + & \\ \{(1-n)/(1+sCR(1-n)/(1-k)\}] & \end{aligned}$$

Equation 17 can be simplified to:

$$I_{OUT}=gm*V_d*[1+sCRn(1-n)/k(1-k)]/[\{1+sCRn/k\}*\{1+sCR(1-n)/(1-k)\}] \quad \text{(Equation 18)}$$

Referring now to FIG. 4B, there are two poles (ωp1, ωp2) and one zero (ωz) in the transfer function from the driver input to the output current:

$$\omega p1=k/nCR \quad \text{(Equation 19)}$$

$$\omega p2=(1-k)/(1-n)CR \quad \text{(Equation 20)}$$

$$\omega z=k(1-k)/n(1-n)CR \quad \text{(Equation 21)}$$

If the strengths of the drivers are proportional to the size of the pass transistor sections, i.e. n=k, it is equivalent to the pass transistor not being split. In this case, there would be only one pole at frequency $1/C_1R_1$.

From equations 19, 20 it can be seen that splitting the pass transistor with disproportional driver strengths creates a pole-zero pair, with the second pole (ωp2) being at a higher frequency than the original pole.

In the foregoing discussion, the term "connected" means at least either a direct electrical connection between the devices connected or an indirect connection through one or more passive or active intermediary devices. The term "circuit" means at least either a single component or a multiplicity of components, either active or passive, that are connected together to provide a desired function. The term "signal" means at least one current, voltage, charge, data, or other signal. It is to be understood that the term transistor can refer to devices including MOSFET, PMOS, and NMOS transistors. Furthermore, the term transistor can refer to any array of transistor devices arranged to act as a single transistor.

The forgoing description sets forth numerous specific details to convey a thorough understanding of the invention. However, it will be apparent to one skilled in the art that the invention may be practiced without these specific details. Well-known features are sometimes not described in detail in order to avoid obscuring the invention. Other variations and embodiments are possible in light of above teachings, and it is thus intended that the scope of invention not be limited by this Detailed Description, but only by the following Claims.

What is claimed is:

1. A fast load transient response circuit in an LDO regulator, comprising:

a feedback loop that senses a load transient;

a first driver having an output impedance equal to R/k and a second driver having an output impedance of R/(1−k) where R is an output impedance necessary to drive a first larger and second smaller pass transistors, and k/R+(1−k)/R=1/R, where k is the constant, having a value greater than zero and less than one, both drivers being responsive to a feedback signal from the feedback loop; and the first pass transistor having a channel width equal to n*W and the second pass transistor having a channel width equal to (1−n) W where W is a channel width required to meet a dropout requirement with sources and drains being coupled to each other and wherein n*W+(1−n)W=W where n is a constant, having a value greater than zero and less than one and a gate of the first pass transistor being driven by the first driver and a gate of the second pass transistor being driven by the second driver, both the pass transistors operating at the same time, wherein a width of a channel to a length of the channel ratio of the first pass transistor is different than that of the second pass transistor such that k is greater than n, the second pass transistor reacting faster than the first pass transistor to a load transient.

2. A fast load transient response circuit for an LDO regulator comprising:

a feedback loop that senses a load transient;

a set of drivers responsive to a feedback signal from the feedback loop having a first driver having an output impedance equal to R/k and a second driver having an output impedance of R/(1−k) where R is an output impedance necessary to drive a first larger and second smaller pass transistors, and k/R+(1−k)/R=1/R, where k is the constant having a value greater than zero and less than one, both drivers being responsive to a feedback signal from the feedback loop; and a set of first and second pass transistors with sources and drains being coupled to each other, and gates of each of the set of pass transistors being individually driven by corresponding one of the set of drivers, both of the pass transistors operating at the same time, the first pass transistor having a channel width equal to n*W and the second pass transistor having a channel width equal to (1−n)W where W is a channel width required to meet a dropout requirement with sources and drains being coupled to each other and wherein n*W+(1−n)W=W where n is a constant having a value greater than zero and less than one; and wherein the width of a channel to a length of the channel ratio (W/L ratio) of the second pass transistor is chosen according to the load transient specification and W/L ratio of the first pass transistor and second pass transistor in combination is chosen according to the dropout specification of the LDO regulator.

3. The fast load transient response circuit of claim 2, wherein the first driver and the second driver are disproportionate in size.

4. The fast load transient response circuit of claim 3, wherein the first driver and the second driver are chosen according to the output driving capability of each driver and an output impedance of each driver.

5. The fast load transient response circuit of claim 2, wherein the width of a channel to a length of the channel ratio of the first pass transistor is higher than that of the second pass transistor.

6. A method comprising:

sensing a load transient;

activating a set of drivers that drives a set of two pass transistors, in response to the load transient, wherein a width of a channel to a length of the channel (W/L) ratio of each of the set of pass transistors is unequal and having a first driver having an output impedance equal to R/k and a second driver having an output impedance of R/(1−k) where R is an output impedance necessary to drive a first larger and second smaller pass transistors, and k/R+(1−k)/R=1/R, where k is the constant having a value greater than zero and less than one, both drivers being responsive to a feedback signal from the feedback loop; and driving gates of each of the set of pass transistors individually using the set of drivers, wherein output impedance of the driver for the one of the two pass transistors having a smaller W/L ratio is lower than the output impedance of another driver, the first pass transistor having a channel width equal to n*W and the second pass transistor having a channel width equal to (1−n)W where W is a channel width required to meet a dropout requirement with sources and drains being coupled to each other and wherein n*W+(1−n)W=W where n is a constant having a value greater than zero and less than one and wherein both of the pass transistors operate at the same time.

* * * * *